US005366285A

United States Patent [19]

Borgen et al.

[11] Patent Number: 5,366,285

[45] Date of Patent: Nov. 22, 1994

[54] SEALING VENDING DRAWER FOR REMOVING DISPENSED PRODUCTS FROM A VENDING MACHINE

[75] Inventors: Arden L. Borgen, Des Moines; Damon E. Rockwell, Grimes, both of Iowa

[73] Assignee: Fawn Engineering Co., Clive, Iowa

[21] Appl. No.: 54,397

[22] Filed: Apr. 28, 1993

[51] Int. Cl.[5] ..... F25D 25/02; F25D 11/00; A47F 3/04

[52] U.S. Cl. ..... 312/404; 312/138.1; 312/211; 312/328; 62/246; 62/250

[58] Field of Search ..... 312/401, 402, 404, 116, 312/138.1, 211, 328, 336; 62/246, 250, 249, 258

[56] References Cited

U.S. PATENT DOCUMENTS

| | | | |
|---|---|---|---|
| 1,981,298 | 11/1934 | Banta | 312/328 |
| 2,062,793 | 12/1936 | Nicol | 312/328 |
| 2,089,709 | 8/1937 | Rabkin | 312/328 |
| 2,215,626 | 9/1940 | Visser | 312/328 |
| 2,408,460 | 10/1946 | Doren | 312/138.1 |
| 2,731,319 | 1/1956 | Jacobs et al. | 312/328 |
| 3,762,790 | 10/1973 | Neuwirth | 312/328 |
| 4,744,175 | 5/1988 | Albright et al. | 312/138.1 X |
| 5,182,923 | 2/1993 | Trulaske, Sr. | 62/249 |
| 5,253,488 | 10/1993 | Kim et al. | 312/402 X |

*Primary Examiner*—Edward K. Look
*Assistant Examiner*—Hoang Nguyen
*Attorney, Agent, or Firm*—Henderson & Sturm

[57] ABSTRACT

A vending machine with an improved sealing holding bin drawer for removing dispensed products. Products are dispensed from a housing chamber which is maintained at a temperature colder than the environment in which the vending machine operates into a holding bin. The holding bin has a first opening allowing the products from the housing chamber to enter. The holding bin has a second opening covered by a door allowing the user to remove dispensed products from the holding bin. A sealing hood selectively covers and seals the first opening between the holding bin and housing chamber. The door and the sealing hood are operably connected such that the sealing hood covers the first hole when the door is opened. The connection is accomplished utilizing a pin and cam slot arrangement. The holding bin can also have an attached storage bin and can be placed on rollers such that it slides out of the vending machine like a drawer.

16 Claims, 2 Drawing Sheets

SEALING VENDING DRAWER FOR REMOVING DISPENSED PRODUCTS FROM A VENDING MACHINE

AUTHORIZATION PURSUANT TO 37 CFR 1.71 (d) (e)

A portion of the disclosure of this patent document may contain material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present invention relates generally to vending machines and more particularly to an improved sealing vending drawer for removing vended products from a cold product vending machine which prevents large exchanges of air between the outside environment and the colder housing chamber used for storing products to be vended.

BACKGROUND ART

Vending machines are used to dispense a wide variety of products. In a cold product vending machine there is a desire to reduce the amount of air flow between the warmer air outside the machine and the cold air in the product storage chamber. Reducing the amount of warm air that enters the product storage chamber prevents repeated and temporary warming of the cold products inside and increases the overall efficiency of the vending machine by eliminating the additional cooling required to compensate for the additional warmth in the storage chamber.

Various methods have been used to help alleviate this problem but have suffered from either a lack of efficiency or from being overly complex. Many methods of preventing access to the storage chamber have been developed as an anti-theft or an anti-tampering feature. These methods typically have one door which swings shut as the door to the retrieval compartment is being opened. When the retrieval door is completely open, the other door is completely closed and prevents user access to the product storage chamber. While these methods due help to slightly reduce the amount of air exchange between the external environmental and the internal chamber once completely closed, they are more specifically design to prevent a hand or other object from being inserted into the chamber and they do not sufficiently reduce the air flow, especially in the interim. Attempts to modify these anti-theft mechanisms to make the doors more insulated and to provide an improved airtight seal are helpful but a large exchange of air takes place before the seal is made.

Attempts have also been made to create an electrical/mechanical door which seals off the housing chamber before allowing a user of the vending machine to remove the product from the retrieval compartment. While this method is efficient from an exchange of air perspective, it can be inconveniently slow. Additionally, it adds another level of complexity to the vending machine and requires additional electricity, control circuitry and system coordination to operate.

Thus, there is a need in a vending for an improved sealing vending drawer for removing products from a cold product vending machine which does not allow for a large exchange of air between the outside environment and the housing chamber used for storing the products to be vended.

DISCLOSURE OF THE INVENTION

The present invention relates generally to vending machines and more particularly to an improved sealing vending drawer for removing vended products from a cold product vending machine which prevents large exchanges of air between the outside environment and the colder housing chamber used for storing products to be vended. A vending machine built in accordance with the present invention includes a housing chamber for storing products to be dispensed, an apparatus for dispensing the products from the housing chamber, an apparatus for maintaining the internal environment of the housing chamber at a relatively constant temperature, and a holding bin for receiving the dispensed products until the user of the vending machine removes them. The constant temperature maintained in the housing chamber is typically colder than the temperature of the environment surrounding the vending machine.

The holding bin has an opening through which the dispensed products enter from the housing chamber. The holding bin has a second opening through which the user may retrieve the dispensed products. The second opening is covered and sealed by a door. The door remains closed unless a user of the vending machine is removing product from the holding bin. The door is connected to a sealing hood which selectively covers the first opening between the holding bin and the housing chamber. The sealing hood creates a relatively air tight seal around the first opening and prevents warm air from entering the housing chamber thus making the vending machine more efficient to operate.

The connection between the door and the sealing hood is such that the sealing hood completely covers the first opening when the door has only been slightly opened and such that the sealing hood remains in that position while the door is opened the rest of the way. This connection is accomplished by the engagement of a pin attached to the side members of the door and a cam slot positioned in side members depending from the sealing hood.

The holding bin can have an attached storage bin for storing excess products that are not placed in the housing chamber. The holding bin with or without the attached storage bin can be placed on rollers such that it can be pulled out of the vending machine like a drawer.

An object of the present invention is to provide an improved vending drawer for a vending machine.

Another object of the present invention is to provide an improved drawer which seals off the product storage compartment while a vended product is being removed.

A further object of the present invention is to provide a vending drawer which can be pulled out to facilitate maintenance.

Another object of the present invention is to provide a vending drawer which also incorporates a storage area for excess products to be vended.

Still another object of the present invention is to provide a vending drawer which is economical, efficient, reliable and easy to use.

Other objects, advantages, and novel features of the present invention will become apparent from the following detailed description of the invention when considered in conjunction with the accompanying drawings.

BEST MODES FOR CARRYING OUT THE INVENTION

Figure 1:
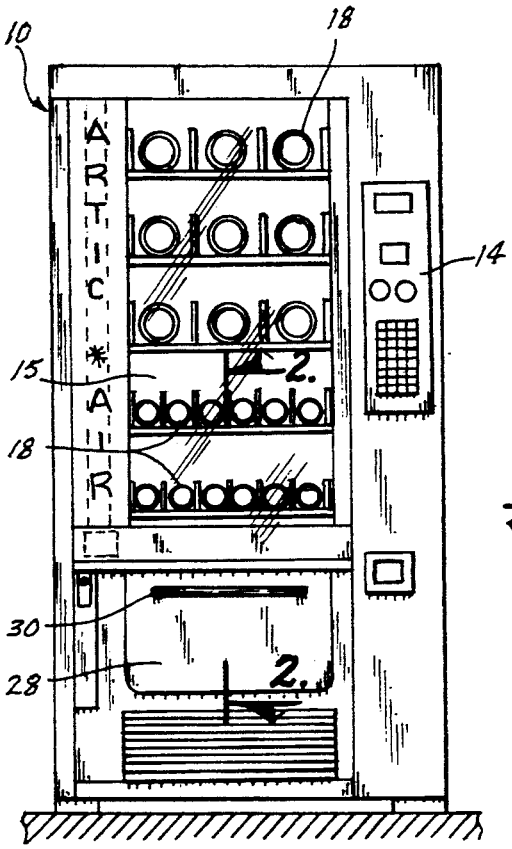
FIG. 1 is a front view of a vending machine with a vending drawer built in accordance with the present invention.
Figure 2:
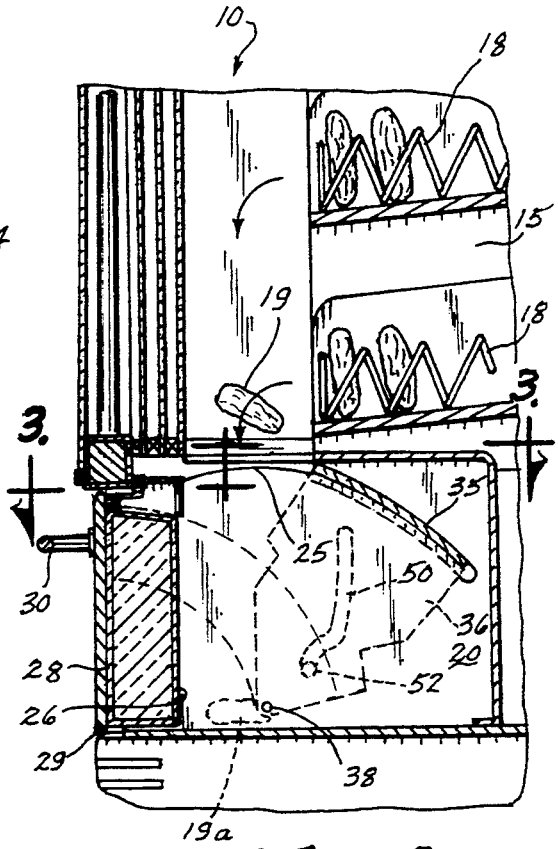
FIG. 2 is a partial vertical sectional view taken along line 2—2 of FIG. 1 showing a vended product being dispensed into the vending drawer.

Referring now to the drawings wherein like reference numerals designate identical or corresponding parts throughout the several. views, FIGS. 1 and 2 show a cold product vending machine (10) built in accordance with the present invention. A user of the vending machine (10) views the various products stored in a housing chamber (15). The user selects the products desired utilizing a control panel (14). The control panel (14) selectively activates one of several dispensing devices (18) which dispenses a selected product (19) into a holding bin (20). The selected product (19) is shown in dashed lines (19*a*) after being dispensed in to the holding bin (20).

The selected product (19) falls into the holding bin through an opening (25) between the housing chamber (15) and the holding bin (20). A second opening (26) in the holding bin (20) is covered and sealed by a door (28). The door (28) allows access by a user of the vending machine (10) to the holding bin (20). The door is pivotally connected to the holding bin (20) by a hinge (29). A handle (30) is connected to the door (28) to assist the user in opening and closing the door (28).

A sealing hood (35) has side members (36) which are rotatably connected to the sides of the holding bin (20) by pivots (38). As the sealing hood (35) and its sides (36) rotate forward about the pivots (38), the sealing hood (35) closes and substantially seals the opening (25) between the housing chamber (15) and the holding bin (20). It is desirable to have the sealing hood (35) in the open position, thus allowing communication between the housing chamber (15) and the holding bin (20), at all times other than when the door (28) is open. Furthermore, it is desirable to have the sealing hood (35) in a closed position, thus sealing the opening (25) between the housing chamber (15) and the holding bin (20), when the door (28) is open to prevent warmer air from entering the housing chamber (15) from the exterior environment.

Referring now to FIGS. 3, 4, 5 and 6, the holding bin (20) is shown connected to a storage bin (40). The storage bin (40) is used to store excess products not placed in the housing chamber (15). The storage bin (40) is located behind the holding bin (20) and is not accessible or viewable to the user of the vending machine (10). It is only accessible to someone capable of opening up the vending machine (10) which is usually locked. The storage bin (40) is maintained at the same temperature as the housing chamber (15). A slide rail (42) and a wheel (43) located on each side allow the combination of the holding bin (20) and storage bin (40) to be pulled out of the vending machine (10) as a drawer (45) by one who is capable of opening the vending machine (10).

Figure 3:
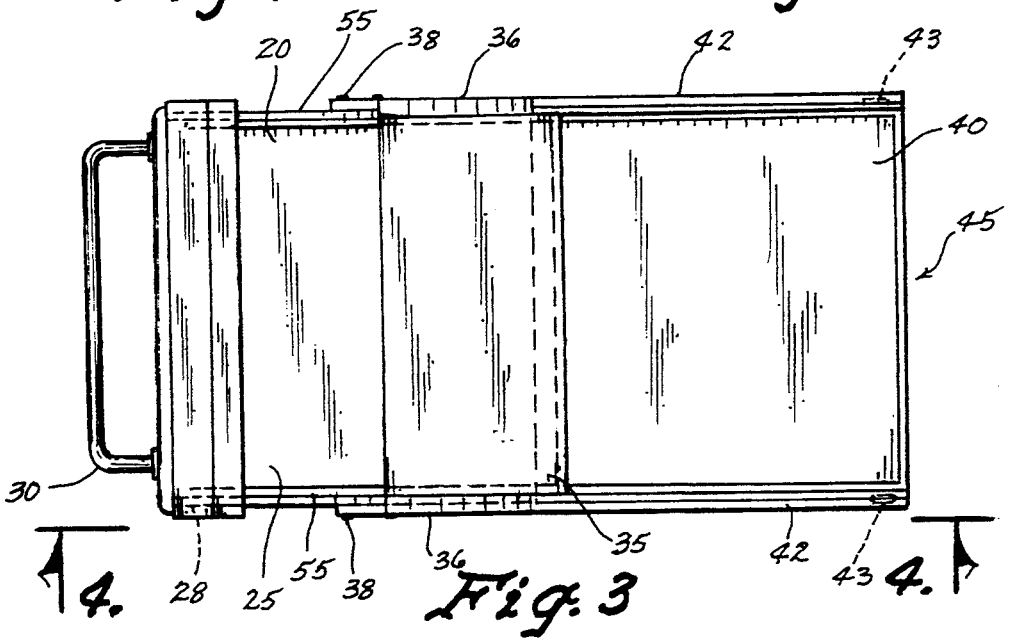
FIG. 3 is a top view taken along line 3—3 of FIG. 2 showing the vending drawer with the sealing hood open.
Figure 4:
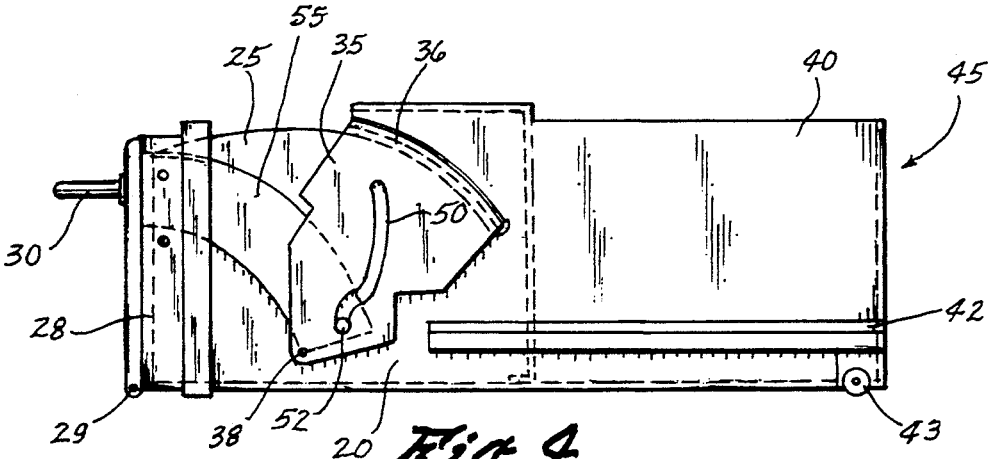
FIG. 4 is a side elevational view taken along line 4—4 of FIG. 3 of the vending drawer of the present invention.
Figure 5:
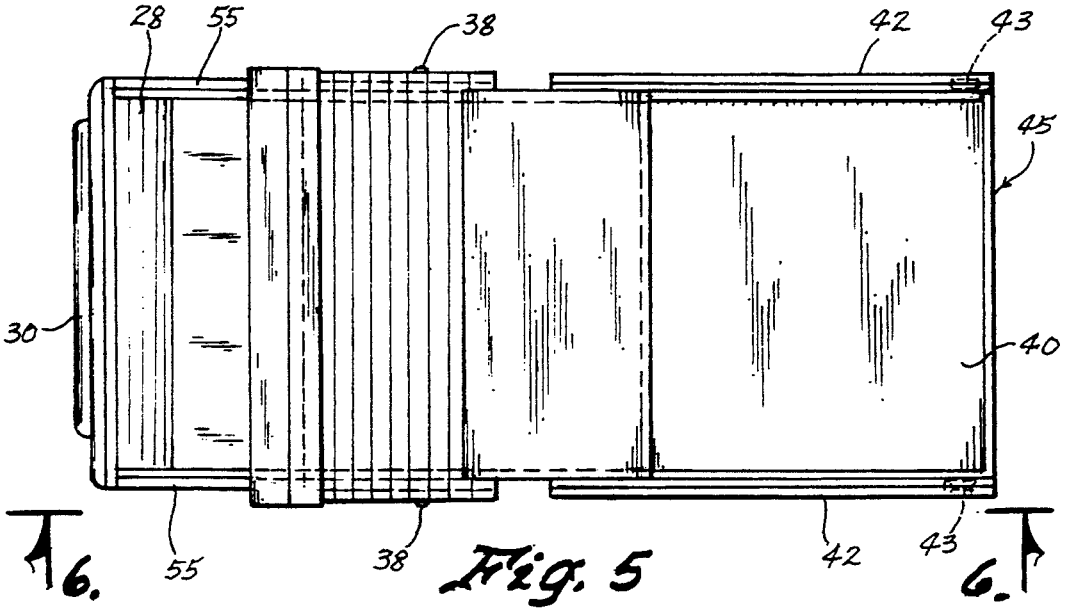
FIG. 5 is a top view of the vending drawer of the present invention showing the door in an open position and the sealing hood in the closed position.
Figure 6:
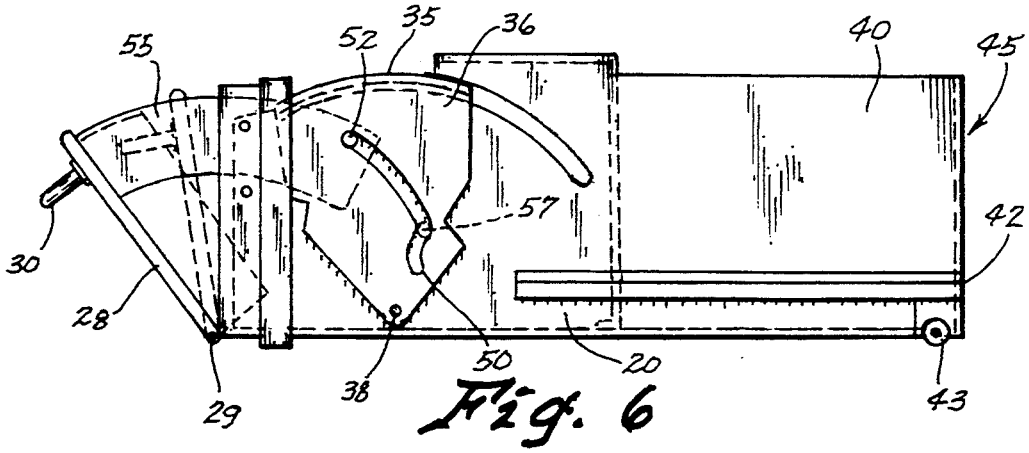
FIG. 6 is side elevational view taken along line 6—6 of FIG. 5 showing in dashed lines the closed position of the sealing hood when the access door is in an intermediate position.

Referring more specifically to FIGS. 3 and 4, the holding bin (20) is shown with the door (28) in the closed position and the sealing hood (35) in the open position. Referring to FIGS. 5 and 6, the door (28) is shown in the open position and the sealing hood (36) is shown in the closed or sealed position. Referring specifically to FIG. 6, the door (28) is shown in dashed lines in an intermediate position. When the door (28) is in the intermediate position, the sealing hood (35) is in the closed position. The sealing hood (36) remains in the closed position when the door (28) is at any position between this intermediate position and the open position.

The various combination of positions between the sealing hood (35) and the door (28) is accomplished using a cam slot (50) which is engaged with a pin (52). In the present embodiment, a corresponding and symmetrical cam slot (50) and corresponding pin 52 is located on each side of the sealing hood (35) and door (28), respectively. However, this is not necessary and the use of only one cam slot and pin is anticipated by this invention. The cam slots (50) are formed within the sides (36) of the sealing hood (35). The door (28) has rigidly attached side members (55). The pins (52) are disposed on two side members (55) of the door (28) and positioned such that the center axis of the pins (52) are perpendicular to the side members (36) of the sealing hood (35). Furthermore, the pins (52) are positioned such that they engage the cam slots (50) form in the side members (36) of the sealing hood (35).

Referring to FIG. 4, when the door (28) is in the closed position, the pin (52) is located at one end of the cam slot (50) and the sealing hood (35) is held in the open position. Referring now to FIG. 6, as the door (28) is opened to the intermediate position, shown in dashed lines, the pin (52) moves along a first arcuate section of the cam slot (50) and forces the sealing hood (35) to upwardly move forward in a counterclockwise direction as viewed. When the door (28) reaches the intermediate position, the pin (52) is in location (57), shown in dashed lines, on the cam slot (50). At this position (57), the sealing hood (35) is closed and sealed relative to the opening (25). It can be seen that due to the thickness of the door (28), the door (28) and the holding bin (20) have remained virtually sealed between the closed and intermediate positions. Thus, at no time was there, or will there be, a direct path through both openings of the holding bin (20). Additionally, the thickness of the door (28) allows the door (28) to be well insulated to prevent energy transfer through the door (28) into the housing chamber (15) while the door (28) is closed.

After the door (28) has reached the intermediate position and the pin (52) has reached position (57), the pin (52) moves along a second arcuate section of the cam slot (50) as the door (28) moves toward the open position. The second arcuate section of the cam slot (50) is designed to be coincident with the arc formed by the pin (52) rotating around the hinge (29). The result is that the sealing hood (35) remains stationary in the closed position as the pin (50) travels along the second arcuate section of the cam slot (50). When the drawer (28) is in the open position, the pin (52) is at the other end of the cam slot (50).

As the door (28) is closed, the action is reversed and the sealing hood (35) remains in the closed position until the door (28) reaches the intermediate position. As the door (28) moves from the intermediate to closed position, the sealing hood (35) is forced back into the open position.

We claim:

1. A vending machine for dispensing products, comprising:

housing chamber means for storing products to be dispensed;

a holding bin, said holding bin having an opening for permitting a user access to said holding bin and door means for sealingly covering said opening, said door means having a closed position wherein said opening is covered, an open position wherein said opening is not covered, and an intermediate position between said open position and said closed position;

dispensing means disposed within said housing chamber means for dispensing products stored in said housing chamber means into said holding bin, said dispensing means including an opening between said housing chamber means and said holding bin;

sealing means for selectively sealing said opening between said housing chamber means and said holding bin whereby energy transfer between said housing chamber means and said holding bin is minimized, said sealing means having a first position permitting open communication between said housing chamber means and said holding bin and a second position sealing said housing chamber means from said holding bin; and means for positioning said sealing means wherein said sealing means is in said first position when said door means is in said closed position, wherein said sealing means is in said second position when said door means is in said intermediate position, and wherein said sealing means stays in said second position when said door means is at every position between said intermediate position and said opening position.

2. The vending machine of claim 1 wherein said positioning means includes at least one side member having a cam slot formed therein, and a pin to engage within said cam slot, said pin having a center axis.

3. The vending machine of claim 2 wherein said cam slot is operably connected to said sealing means and wherein said pin is operably connected to said door means.

4. The vending machine of claim 3 wherein the center axis of said pin is perpendicular to said side member.

5. The vending machine of claim 4 wherein the cam slot comprises a first arcuate section and a second arcuate section, said first arcuate section having a curvature to promote rapid movement of said sealing means and said second arcuate section having a curvature to promote no relative motion of said sealing means.

6. The vending machine of claim 5 including means for pivoting said at least one side member with respect to said holding bin.

7. The vending machine of claim 6 including means for pivoting said door means with respect to said holding bin.

8. The vending machine of claim 7 wherein said pin is rigidly connected to said door means whereby said pin stays in the same position relative to said door means.

9. The vending machine of claim 1 including means for maintaining the interior of said housing chamber means at a relatively constant temperature which may be different from the ambient temperature exterior to the vending machine.

10. The vending machine of claim 9 wherein the interior temperature of said housing chamber is maintained at a level lower than the ambient temperature exterior to the vending machine.

11. The vending machine of claim 1 wherein said door means is constructed of a highly insulated material.

12. The vending machine of claim 1 including a storage bin attached to said holding bin wherein excess products which are not placed in said housing chamber can be stored in the same environment.

13. The vending machine of claim 12 including sliding means attached to said storage bin and said holding bin for extracting said storage bin and said holding bin from the vending machine.

14. The vending machine of claim 1 including means for maintaining a substantial seal by said door mean when said door means is at every position between said closed position and intermediate position.

15. A vending machine for dispensing products, comprising:

housing chamber means for storing products to be dispensed and including an opening formed therein;

a holding bin having an open top and located below said opening, said holding bin having a door means for selectively providing access to said holding bin, said door means having a closed position preventing access, an open position providing access, and an intermediate position between said open position and said closed positions;

dispensing means disposed within said housing chamber means for dispensing products stored in said housing chamber means through said opening and into said holding bin;

closing means for selectively closing said opening whereby energy transfer between said housing chamber means and said holding bin is minimized, said closing means having a first position maintaining said opening open to provide fluid communication between said housing chamber means and said holding bin and a second position closing said opening thereby preventing fluid communication between said housing chamber means and said holding bin; and means for positioning said closing means wherein said closing means is in said first position when said door means is in said closed position, wherein said closing means is in said second position when said door means is in said intermediate position, and wherein said closing means remains in said second position during movement of said door means between said intermediate position and said open position.

16. The vending machine of claim 1 including:

said sealing means having depending side members disposed adjacent said holding bin;

a cam slot formed within at least one of said side members;

said door means having side portions disposed adjacent said side members; and at least one pin positioned on one of said side members and operatively engaged with said cam slot.

* * * * *